US009777450B2

(12) United States Patent
Katahira et al.

(10) Patent No.: US 9,777,450 B2
(45) Date of Patent: Oct. 3, 2017

(54) SNOW REMOVAL DEVICE, VEHICLE, AND TRACK TRANSPORTATION SYSTEM

(71) Applicant: MITSUBISHI HEAVY INDUSTRIES, LTD., Tokyo (JP)

(72) Inventors: Kousuke Katahira, Tokyo (JP); So Tamura, Tokyo (JP)

(73) Assignee: MITSUBISHI HEAVY INDUSTRIES, LTD., Tokyo (JP)

( * ) Notice: Subject to any disclaimer, the term of this patent is extended or adjusted under 35 U.S.C. 154(b) by 109 days.

(21) Appl. No.: 14/839,867

(22) Filed: Aug. 28, 2015

(65) Prior Publication Data

US 2016/0069033 A1 Mar. 10, 2016

(30) Foreign Application Priority Data

Sep. 9, 2014 (JP) ..... 2014-183099

(51) Int. Cl.
*E01H 8/00* (2006.01)
*E01H 8/06* (2006.01)
*E01H 5/09* (2006.01)

(52) U.S. Cl.
CPC ..... *E01H 8/06* (2013.01); *E01H 5/092* (2013.01)

(58) Field of Classification Search
CPC ..... E01H 8/06; E01H 5/092
USPC ..... 104/279
See application file for complete search history.

(56) References Cited

U.S. PATENT DOCUMENTS 2,318,127 A * 5/1943 Stewart ..... E01H 8/06 37/211
3,034,236 A * 5/1962 Pyke ..... E01H 8/06 104/279
3,305,949 A * 2/1967 Holley ..... E01H 8/06 172/96
3,886,675 A * 6/1975 Maisonneuve ..... E01H 8/06 15/54
4,151,663 A * 5/1979 Schmidt ..... E01H 8/06 37/211
4,354,320 A * 10/1982 Schmidt ..... E01H 8/06 172/667

(Continued)

FOREIGN PATENT DOCUMENTS

JP 5-33311 A 2/1993
JP 2003-268741 A 9/2003
JP 2010-241312 A 10/2010

*Primary Examiner* — Jason C Smith
(74) *Attorney, Agent, or Firm* — Kanesaka Berner and Partners LLP

(57) ABSTRACT

A snow removal device includes: a brush rotary shaft that is mounted on a vehicle body traveling along a track and in front of a running wheel of the vehicle body and that is rotated in a direction opposite to the rotation direction of the running wheel; a travel brush part that protrudes radially outward from an outer circumferential surface of the brush rotary shaft and comes into contact with a runway of the track with which the running wheel is in contact; and a brush pressing part that presses the travel brush part toward the runway. The travel brush part is provided in a spiral region formed on the outer circumferential surface of the brush rotary shaft in a spiral manner extending toward an axis direction in which the axis extends as going toward a circumferential direction of the brush rotary shaft.

10 Claims, 12 Drawing Sheets

(56) References Cited

U.S. PATENT DOCUMENTS

| | | | | |
|---|---|---|---|---|
| 4,760,657 | A * | 8/1988 | Ganzmann | E01H 5/092 15/82 |
| 2003/0110665 | A1* | 6/2003 | Mathison | E01H 8/06 37/198 |
| 2003/0230008 | A1* | 12/2003 | Verseef | E01H 5/092 37/208 |
| 2010/0258026 | A1* | 10/2010 | Kanemori | E01H 8/00 104/279 |
| 2012/0222580 | A1* | 9/2012 | Grammatis | E01H 8/06 104/279 |
| 2014/0259476 | A1* | 9/2014 | Amin | E01H 1/056 15/82 |
| 2015/0033589 | A1* | 2/2015 | McAdam | E01H 5/06 37/231 |
| 2015/0047232 | A1* | 2/2015 | Kassander | E01H 5/09 37/259 |
| 2016/0060835 | A1* | 3/2016 | Katahira | E01H 5/092 104/279 |
| 2016/0069033 | A1* | 3/2016 | Katahira | E01H 5/092 104/279 |
| 2016/0201279 | A1* | 7/2016 | Wuillemin | E01H 1/0818 37/197 |
| 2016/0230787 | A1* | 8/2016 | Wagner | F15B 21/042 |
| 2016/0369467 | A1* | 12/2016 | Rogers | E01H 5/102 |

* cited by examiner

SNOW REMOVAL DEVICE, VEHICLE, AND TRACK TRANSPORTATION SYSTEM

BACKGROUND OF THE INVENTION

Field of the Invention

The present invention relates to a snow removal device, a vehicle, and a track transportation system.

Priority is claimed on Japanese Patent Application No. 2014-183099, filed on Sep. 9, 2014, the content of which is incorporated herein by reference.

Description of Related Art

As a new means of transportation other than a bus or a railway, a track transportation system traveling on a track using running wheels made of, for example, rubber tires, is known. Such a track transportation system is generally referred to as a new transportation system or an automated people mover (APM).

A vehicle employed in this track transportation system is equipped with, for instance, power collection parts provided for a lateral portion thereof, and a guide wheel installed in parallel with the power collection parts. Trolley wires for supplying the vehicle with power via the power collection parts and a guide rail with which the guide wheel comes into contact to thereby guide the vehicle in a running direction are provided on the track along which the vehicle travels. For this reason, the vehicle of the track transportation system travels along the guide rail while the power is supplied by bringing the power collection parts into contact with the trolley wires. The vehicle of the track transportation system is often automatically operated unattended, and there is a risk of snow that has accumulated from a snowfall forming an obstacle in the way of traffic.

To remove such snow, for instance, a device for removing obstacles on a track for a guide rail type vehicle is disclosed in Japanese Unexamined Patent Application, First Publication No. 2010-241312, and is capable of removing the obstacles on the track such as snow or foreign materials. To be specific, the device for removing obstacles on a track for a guide rail type vehicle, which is disclosed in Japanese Unexamined Patent Application, First Publication No. 2010-241312, is equipped with frames that are provided in front of wheels in a running direction, and lifting units that are mounted on the frames and raise or lower brush holders holding removal brushes for the obstacles on the track. The device for removing obstacles on a track removes the obstacles on the track by pressing the brush holders downward using the lifting units and bringing the removal brushes into contact with a track surface.

Incidentally, the device described above in Japanese Unexamined Patent Application, First Publication No. 2010-241312 removes the obstacles on the track by pushing the removal brushes by the vehicle in the running direction of the vehicle in a state in which the removal brushes come into contact with the track surface. Therefore, the removal brushes are pushed in the running direction while continuing to be in contact with the track surface, and are damaged by wear. Also, as the removal brushes are damaged due to the wear, a gap occurs between the track surface and the removal brush, and snow that has accumulated thinly on the runways may not be sufficiently removed.

SUMMARY OF THE INVENTION

The present invention provides a snow removal device and a vehicle, which are capable of effectively removing snow that has accumulated on trolley wires while limiting damage caused by wear.

In a first aspect of the present invention, a snow removal device includes: a brush rotary shaft that is mounted on a vehicle body traveling along a track in front of running wheel provided for the vehicle body in a running direction in which the vehicle body travels and that is rotated about an axis extending in a direction along a vehicle width direction of the vehicle body in a direction opposite to the rotation direction of the running wheel; a travel brush part that protrudes radially outward from an outer circumferential surface of the brush rotary shaft and comes into contact with a runway of the track with which the running wheel is in contact; and a brush pressing part that presses the travel brush part toward the runway. The travel brush part is provided in a spiral region formed on the outer circumferential surface of the brush rotary shaft in a spiral manner extending toward an axis direction in which the axis extends as going toward a circumferential direction of the brush rotary shaft.

According to this constitution, as the brush rotary shaft is rotated in the direction opposite to the rotation direction of the running wheel, snow that has accumulated on the runway can be scraped out from a lower side toward an upper side in the vertical direction by the travel brush part. As the brush rotary shaft is rotated in the direction opposite to the rotation direction of the running wheel and scrapes out snow to scoop up snow from the lower side to the upper side in the vertical direction, snow that has accumulated on the runway can be efficiently removed with no compression. Further, as the travel brush part is provided in the spiral region, snow scraped off from the top of the runway can be sent in the vehicle width direction rather than forward in the running direction. Further, in a state in which the travel brush part is in contact with the runway, the brush rotary shaft is rotated. Thereby, the travel brush part comes into contact with the runway over the entire circumferential area thereof. Therefore, it is possible to make an amount of wear of the travel brush part uniform in the circumferential direction of the travel brush part, and to limit a partial increase in the amount of wear of the travel brush part.

Also, in snow removal device, the brush rotary shaft may be rotated against a frictional force generated by contact of the travel brush part with the runway when the vehicle body travels.

According to this constitution, the travel brush part can be rotated in the direction opposite to the rotation direction of the running wheel with the travel brush part brought into contact with the runway with high precision. As a result, it is possible to scrape off snow that has accumulated on the runway from the lower side to the upper side in the vertical direction with high precision. Thereby, snow that has accumulated on the runway can be efficiently removed.

Also, in snow removal device, the brush rotary shaft may be rotated such that a relative rotating speed of the brush rotary shaft relative to the runway is faster than that of the running wheel relative to the runway.

According to this constitution, it is possible to bring the travel brush part into contact with snow that has accumulated on the runway at a high speed. As a result, it is possible to scrape out snow that has accumulated on the runway to scoop up snow from the lower side to the upper side in the vertical direction with a great force. Thereby, snow that has accumulated on the runway can be still more efficiently removed.

Also, in the snow removal device, the spiral region may have: a first spiral region that is formed on the outer circumferential surface of the brush rotary shaft to extend toward the axis direction from an intermediate position of the outer circumferential surface of the brush rotary shaft in the axis direction as going toward first direction in the circumferential direction; and a second spiral region that is formed on the outer circumferential surface of the brush rotary shaft to extend toward the axis direction from the intermediate position of the outer circumferential surface of the brush rotary shaft in the axis direction as going toward second direction in the circumferential direction.

According to this constitution, snow that has accumulated on the runway can be sent toward near outside of the runway at each of the first spiral region and the second spiral region using the middle of the runway in the vehicle width direction as a boundary. Thereby, compared with a case thatsnow is simply sent only to one side in the vehicle width direction, snow on the runway can be more efficiently removed.

Also, the snow removal device may further include a controller that controls so as to adjust rotation of the brush rotary shaft and a pressing force of the brush pressing part.

According to this constitution, control of adjustment of the pressing force of the brush pressing part and the rotating speed of the brush rotary shaft is performed. Thereby, it is possible to adjust the pressing force of the travel brush part against the runway and the rotating speed of the travel brush part depending on the type or amount of snow. For this reason, it is possible to adequately bring the travel brush part into contact with the runway according to a snowfall situation or a situation of the accumulated snow.

Also, in the snow removal device, the axis may be obliquely disposed such that a first end of the brush rotary shaft in the vehicle width direction is located forward in the running direction relative to a second end of the brush rotary shaft in the vehicle width direction.

According to this constitution, as the travel brush part is rotated, snow scraped off from the top of the runway can be more efficiently sent toward one side (the side of the second end of the brush rotary shaft) in the vehicle width direction.

Also, the snow removal device may further include a rotation transmission part configured to transmit rotation of the running wheel to rotate the brush rotary shaft. The rotation transmission part may include: a running wheel contact shaft that rotates while coming into contact with the running wheel; and a speed change part that changes a rotating speed of the running wheel contact shaft and transmits the changed rotating speed to the brush rotary shaft.

According to this constitution, as the rotation of the running wheel is transmitted to the brush rotary shaft via the speed change part, a power source for rotating the brush rotary shaft need not be prepared outside.

Also, in the snow removal device, the speed change part may change the number of rotations of the brush rotary shaft depending on the speed of the vehicle body.

According to this constitution, it is possible to rotate the travel brush part, the number of optimal rotations depending on the speed of the vehicle body corresponding to the type or amount of snow that has accumulated on the runway.

Also, in a second aspect of the present invention, a vehicle includes a vehicle body having the snow removal device.

Also, in a third aspect of the present invention, a track transportation system includes the vehicle, and a track along which the vehicle body travels.

According to this constitution, the vehicle can be efficiently driven while removing snow that has accumulated on the runway. For this reason, it is possible to limit service disruptions or train delays caused by the accumulated snow.

According to the present invention, as the travel brush part is brought into contact with the runway while being rotated by the brush rotary shaft in the direction opposite to the rotation direction of the running wheel, snow that has accumulated on the runway can be efficiently removed while damage caused by the wear of the brush part body is limited.

DETAILED DESCRIPTION OF THE INVENTION (First Embodiment)

Hereinafter, a first embodiment of the present invention will be described with reference to FIGS. 1 to 4.

Figure 1:
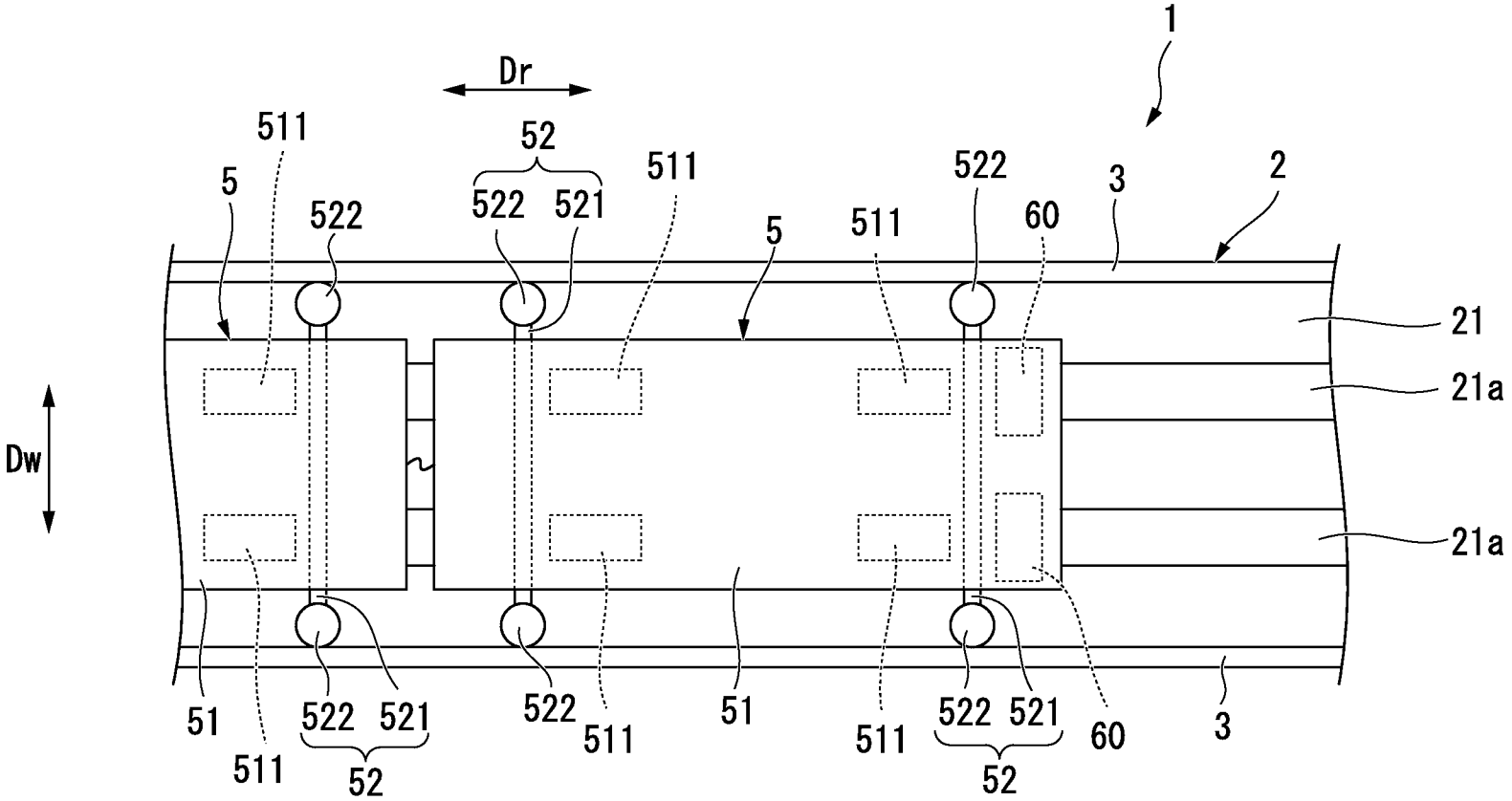
FIG. 1 is a schematic view showing a track transportation system in an embodiment of the present invention.

As shown in FIG. 1, a combination vehicle according to a first embodiment of the present invention is a combination vehicle of a track transportation system 1 that travels on a track 2 while being guided by guide rails 3 provided for the track 2. The track transportation system 1 of the present embodiment is a lateral guide rail type (side guide type) transportation system in which the guide rails 3 are provided on both sides of the track 2 in a width direction and extend in an extending direction of the track 2. In the present embodiment, a plurality of vehicles 5 is connected to each other to constitute the combination vehicle.

The track 2 extends along a predetermined service route, in which linear sections and curved sections are mixed as needed. The track 2 has a track surface 21 that is nearly horizontally provided. The track surface 21 and the sidewalls 22 are integrally built of, for example, concrete.

Figure 3:
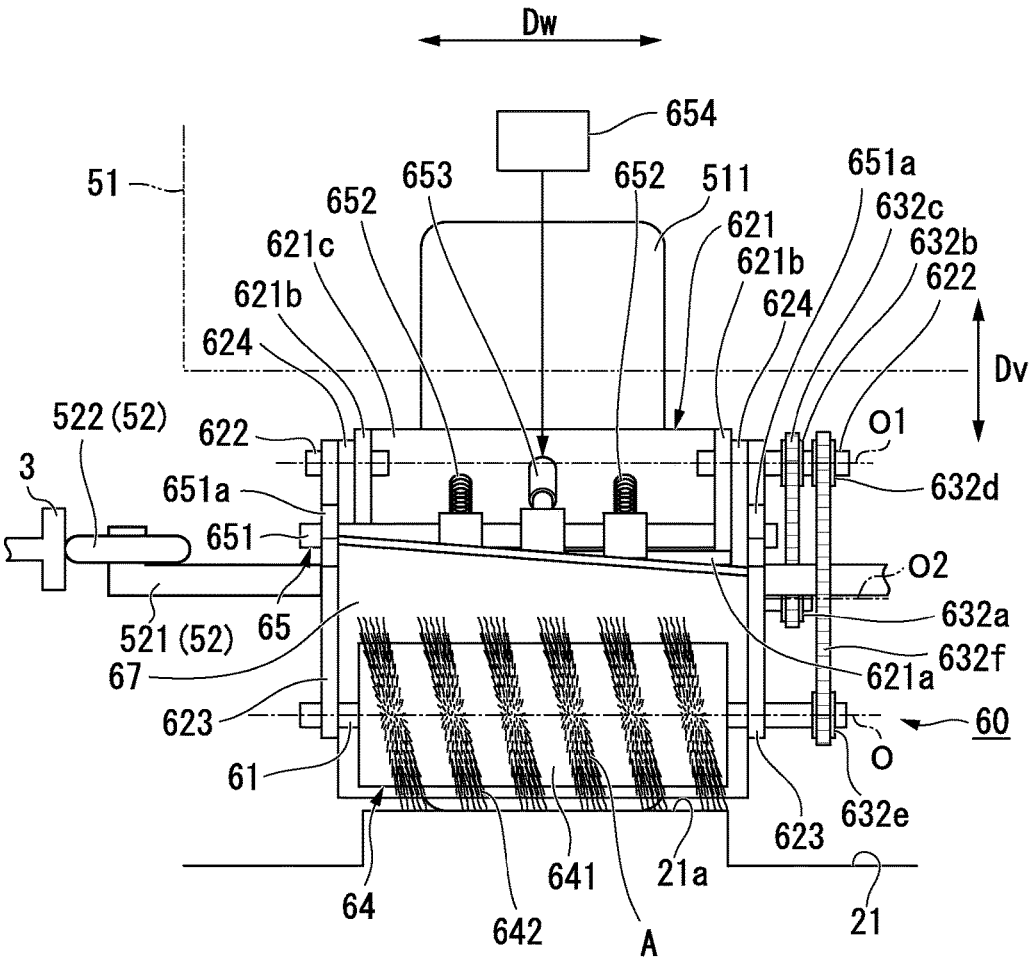
FIG. 3 is a view of the snow removal device in the first embodiment of the present invention when viewed from the front in a running direction.

Runways 21*a* along which the vehicle 5 travels are formed on the track surface 21. The runways 21*a* are separated in a horizontal direction to correspond to running wheels 511 of the vehicle 5 to be described below, and are formed at two places. As shown in FIG. 3, the runways 21*a* are formed to protrude upward from the track surface 21 in a vertical direction Dv such that upper surfaces thereof provide overall flat surfaces on which the running wheels 511 can roll in contact with the upper surfaces.

As shown in FIGS. 1 to 4, the vehicle 5 is equipped with a vehicle body 51 that travels along the track 2, guide devices 52 that guide the vehicle body 51 along the track 2, and snow removal devices 60 that are disposed in the front of the vehicle body 51 in a running direction Dr in which the vehicle body 51 travels. Here, in the present embodiment, the running direction Dr of the vehicle body 51 is a direction in which the vehicle body 51 progresses, and is a leftward/rightward direction of the plane on which FIG. 1 is shown.

The vehicle body 51 has a structure which has a box shape in an exterior view and in which a cavity is present. The vehicle body 51 is provided with an opening/closing door and windows (not shown) at a lateral portion thereof, and a pair of left and right running wheels 511 at a bottom portion thereof. The running wheels 511 are driven and rotated by a power-driven part (not shown). As the running wheels 511, for example, rubber tires are used. The running wheels 511 are in contact with the runways 21*a* of the track surface 21, and move forward while being rotated. Thereby, the vehicle body 51 travels along the track 2.

The guide devices 52 are each equipped with a guide frame 521 that is provided at a lower side of the vehicle body 51, and guide wheels 522 that are rotatably supported by the guide frame 521.

The guide frame 521 extends in the vehicle width direction Dw, and opposite ends thereof are located outside the running wheels 511 in the vehicle width direction Dw. The opposite ends of the guide frame 521 are provided with the respective guide wheels 522. Here, in the present embodiment, the vehicle width direction Dw of the vehicle body 51 is a width direction of the track 2, and is an upward/downward direction of the plane on which FIG. 1 is shown. Also, the inside (of the track 2) in the vehicle width direction Dw is a center side of the vehicle body 51, and the outside (of the track 2) in the vehicle width direction Dw is a lateral side of the vehicle body 51 which is a side at which the guide wheel 522 is provided.

The guide wheels 522 are disposed outside the lateral surfaces of the vehicle body 51, and are supported by the guide frame 521 to be rotatable about their rotational axes in the vertical direction Dv. The guide wheels 522 are provided at approximately the same height as the guide rails 3. Therefore, when the vehicle 5 travels, the guide wheels 522 are rotated by coming into contact with the guide rails 3.

The snow removal devices 60 remove snow on the runways 21*a*. As shown in FIG. 1, the snow removal devices 60 are provided in front of the running wheels 511 provided for the vehicle body 51 in the running direction Dr. Each of the snow removal devices 60 is mounted on the vehicle body 51 via the guide frame 521. As shown in FIG. 1, the snow removal devices 60 of the present embodiment are provided for a foremost vehicle 5 that is disposed at the forefront in the running direction Dr among the plurality of connected vehicles 5.

Figure 2:
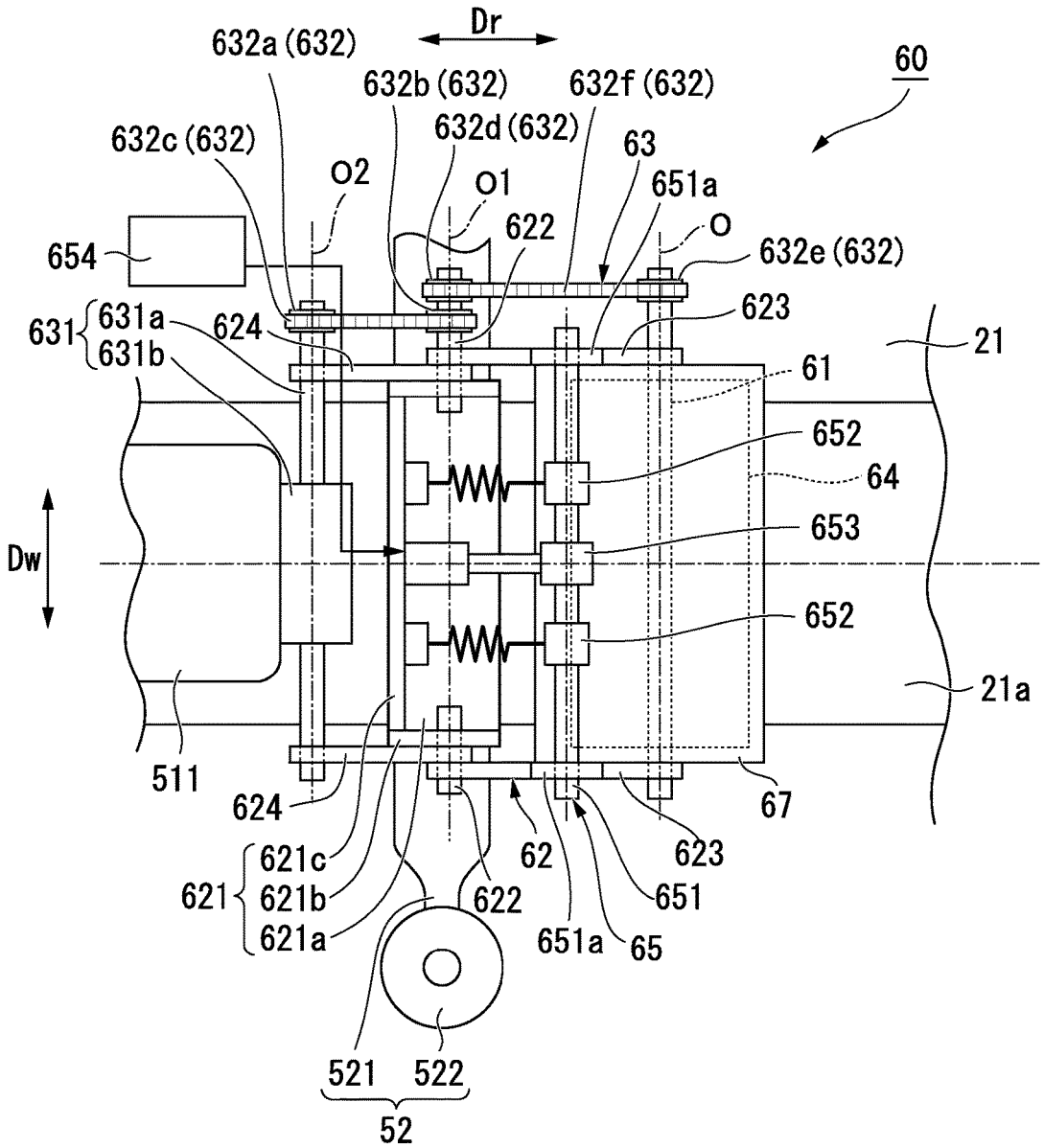
FIG. 2 is a view of a snow removal device in a first embodiment of the present invention when viewed from above in a vertical direction.
Figure 4:
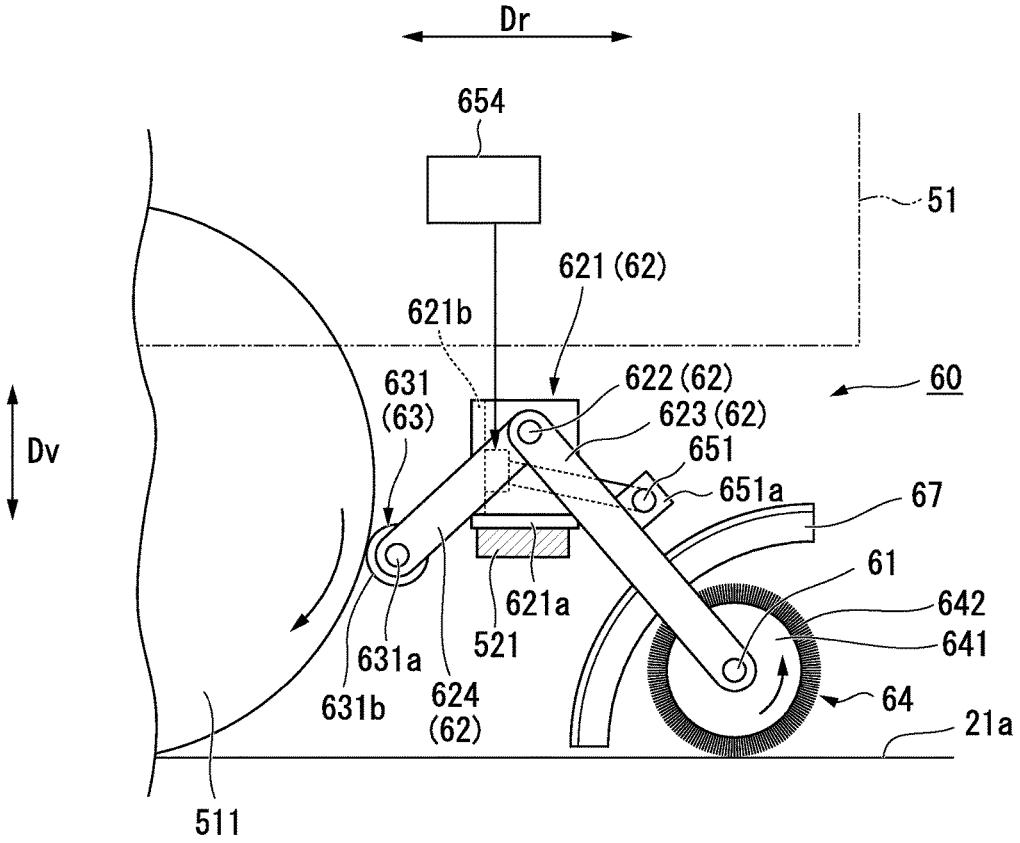
FIG. 4 is a view of the snow removal device in the first embodiment of the present invention when viewed from outside in a vehicle width direction.

As shown in FIGS. 2 to 4, the snow removal device 60 of the present embodiment is equipped with a brush rotary shaft 61 that is rotated about an axis O extending in a direction along the vehicle width direction Dw, a mounting support part 62 that rotatably supports the brush rotary shaft 61 and mounts the brush rotary shaft 61 on the vehicle body 51, a rotation transmission part 63 that rotates the brush rotary shaft 61, a travel brush part 64 that protrudes radially outward from an outer circumferential surface of the brush rotary shaft 61, a brush pressing part 65 that presses the travel brush part 64 toward the runway 21*a*, and a brush back plate 67 that covers the travel brush part 64.

The brush rotary shaft 61 is rotated about the axis O extending in the vehicle width direction Dw. When the vehicle body 51 travels, the brush rotary shaft 61 is rotated against a frictional force generated by contact of the travel brush part 64 with the runway 21*a*. The brush rotary shaft 61 is rotated such that a relative rotating speed thereof relative to the runway 21*a* is faster than that of the running wheel 511 relative to the runway 21*a* during travel.

The brush rotary shaft 61 of the present embodiment has the shape of a column that extends centering on the axis O. The brush rotary shaft 61 rotates such that a surface thereof facing the runway 21*a* goes from the front to the rear in the running direction Dr. That is, the brush rotary shaft 61 is rotated in the direction opposite to the rotation direction of the running wheel 511. To be specific, the brush rotary shaft 61 of the present embodiment is rotated such that the outer circumferential surface thereof goes from the lower side in the vertical direction Dv to the front in the running direction Dr and then goes to the upper side in the vertical direction Dv. The brush rotary shaft 61 is rotated in a state in which the frictional force generated when the travel brush part 64 is brought into contact with the runway 21*a* by the brush pressing part 65 is reduced. The brush rotary shaft 61 is rotated at an adjusted rotating speed such that a relative rotating speed on a contact surface coming into contact with the runway 21*a* is faster than a relative rotating speed on a contact surface of the running wheels 511 which comes into contact with the runway 21*a* during travel by the rotation transmission part 63.

The mounting support part 62 mounts the brush rotary shaft 61 on the vehicle body 51 via the guide frame 521. The mounting support part 62 rotatably supports the brush rotary shaft 61. The mounting support part 62 of the present embodiment includes a support part body 621 that is fixed to the guide frame 521, support shafts 622 that are mounted on the support part body 621, first support plates 623 that connect the support shafts 622 and the brush rotary shaft 61, and second support plates 624 that connect the support shafts 622 and a running wheel contact shaft 631 of the rotation transmission part 63 to be described below.

The support part body 621 is fixed to the guide frame 521 in front of the running wheel 511 in the running direction Dr. The support part body 621 of the present embodiment includes a fixing plate portion 621 a that is fixed to an upper surface of the guide frame 521 in the vertical direction Dv, lateral plate portions 621*b* that are fixed from opposite ends of the fixing plate portion 621*a* in the vehicle width direction Dw to the upper side of the fixing plate portion 621*a* in the vertical direction Dv, and a rear plate portion 621*c* that connects the lateral plate portions 621*b* to each other at a rear end of the fixing plate portion 621*a* in the running direction Dr.

The fixing plate portion 621*a* has the shape of a flat plate extending in the vehicle width direction Dw. The fixing plate portion 621*a* is fixed in a state in which a wide surface thereof is placed on the upper surface of the guide frame 521 in the vertical direction Dv.

The lateral plate portions 621*b* are fixed to the respective opposite ends of the fixing plate portion 621*a* in the vehicle width direction Dw. The lateral plate portions 621*b* extend from the fixing plate portion 621*a* toward the upper side in the vertical direction Dv in a flat plate shape.

The rear plate portion 621*c* is fixed to the rear end of the fixing plate portion 621*a* in the running direction Dr.

The rear plate portion 621*c* extends from the fixing plate portion 621*a* toward the upper side in the vertical direction Dv in a flat plate shape, and opposite ends thereof in the vehicle width direction Dw are fixed to the lateral plate portions 621*b*.

The support shafts 622 are supported by the support part body 621 to be rotatable about a support axis O1 extending in parallel with the axis O of the brush rotary shaft 61. The support shafts 622 of the present embodiment are provided for the lateral plate portions 621*b* at the opposite sides in the vehicle width direction Dw. The support shafts 622 are rotatably mounted on the lateral plate portions 621*b*. Each of the support shafts 622 has the shape of a column, and extends in parallel to the rotary shaft of the running wheel 511 or the axis O of the brush rotary shaft 61.

The first support plates 623 rotatably support the support shafts 622 and the brush rotary shaft 61.

The two first support plates 623 are provided to sandwich the mounting support part 62 outside of the lateral plate portions 621*b* in the vehicle width direction Dw. The first support plates 623 are mounted to be rotatable relative to the lateral plate portions 621*b*. The first support plates 623 of the present embodiment have the shapes of flat plates that are disposed in parallel with the lateral plate portions 621*b* and extend in the running direction Dr. Each of the first support plates 623 is formed with holes into which each support shaft 622 and the brush rotary shaft 61 can be inserted.

The second support plates 624 rotatably support the support shafts 622 and the running wheel contact shaft 631 to be described below. The second support plates 624 are provided to be sandwiched between the first support plates 623 outside of the lateral plate portions 621*b* in the vehicle width direction Dw. The two second support plates 624 are disposed to sandwich the mounting support part 62, and are mounted to be rotatable relative to the lateral plate portions 621*b*. The second support plates 624 are fixed to the first support plates 623. That is, the second support plates 624 rotate about the support shafts 622 relative to the lateral plate portions 621*b* along with the first support plates 623. The second support plates 624 of the present embodiment have the shapes of flat plates that are disposed in parallel with the lateral plate portions 621*b* and extend in the running direction Dr. Each of the second support plates 624 is formed with holes into which the running wheel contact shaft 631 and each support shaft 622 can be inserted.

The rotation transmission part 63 rotates the brush rotary shaft 61 using external power. The rotation transmission part 63 of the present embodiment transmits rotation of the running wheel 511, which acts as the external power, to rotate the brush rotary shaft 61. To be specific, the rotation transmission part 63 of the present embodiment presses a roller to the running wheel 511, and thereby obtains the rotational power of the brush rotary shaft 61. The rotation transmission part 63 rotates the brush rotary shaft 61 such that the relative rotating speed of the brush rotary shaft 61 relative to the runway 21*a* is faster than the relative rotating speed of the running wheel 511 relative to the runway 21*a*. The rotation transmission part 63 of the present embodiment includes a running wheel contact shaft 631 that comes into contact with the running wheel 511, and a speed change part 632 that changes the speed of rotation of the running wheel contact shaft 631 to transmit it to the brush rotary shaft 61.

The running wheel contact shaft 631 is a roller that is rotated about a contact rotary axis O2 extending in parallel with the rotary shaft of the running wheel 511 while in contact with the running wheel 511. The running wheel contact shaft 631 of the present embodiment includes a contact shaft body 631*a* that extends centering on the contact rotary axis O2, and a contact portion 631*b* that is fixed to the contact shaft body 631*a* and comes into contact with the running wheel 511.

The contact shaft body 631*a* has the shape of a column that centers on the contact rotary axis O2.

The contact portion 631*b* has the shape of a cylinder that centers on the contact rotary axis O2. The contact portion 631*b* is fixed to an outer circumferential surface of the contact shaft body 631*a* with the contact shaft body 631*a* inserted thereinto. An outer circumferential surface of the contact portion 631*b* comes into contact with the outer circumferential surface of the running wheel 511.

The speed change part 632 increases a speed such that the rotating speed of the brush rotary shaft 61 is faster than that of the contact shaft body 631*a*, and transmits power. The speed change part 632 of the present embodiment includes a first gear 632*a* that is provided for the contact shaft body 631*a*, a second gear 632*b* that is provided for one of the support shafts 622, a first chain part 632*c* that connects the first gear 632*a* and the second gear 632*b*, a third gear 632*d* that is provided for one of the support shafts 622 in parallel with the second gear 632*b*, a fourth gear 632*e* that is provided for the brush rotary shaft 61, and a second chain part 632*f* that connects the third gear 632*d* and the fourth gear 632*e*. The speed change part 632 changes gear ratios of the first gear 632*a*, the second gear 632*b*, the third gear 632*d*, and the fourth gear 632*e* to thereby make the relative rotating speed of the brush rotary shaft 61 relative to the runway 21*a* faster than the relative rotating speed of the contact shaft body 631*a* relative to the runway 21*a*. To be specific, in the speed change part 632 of the present embodiment, to satisfy, for example, the number of rotations of the running wheel 511×(diameter of the running wheel 511/diameter of the first gear 632*a*)×(diameter of the first gear 632*a*/diameter of the second gear 632*b*)×(diameter of the third gear 632*d*/diameter of the fourth gear 632*e*) >(diameter of the running wheel 511/maximum outer diameter of the travel brush part 64), the gear ratios are set to select an optimum sprocket ratio from a structure or a size.

The first gear 632*a* is a sprocket fixed to the contact shaft body 631*a*. The first gear 632*a* is fixed to an inner end of the contact shaft body 631*a* in the vehicle width direction Dw. The first gear 632*a* is rotated together with the contact shaft body 631*a*.

The second gear 632*b* is a sprocket fixed to one of the support shafts 622. The second gear 632*b* is fixed to an outer circumferential surface of the support shaft 622 to have the same position as the first gear 632*a* in the vehicle width direction Dw. The second gear 632*b* is rotated together with the support shaft 622.

The first chain part 632*c* is a roller chain that connects the first gear 632*a* and the second gear 632*b*. As the first gear 632*a* rotates, the first chain part 632*c* rotates the second gear 632*b*.

The third gear 632*d* is a sprocket fixed to one of the support shafts 622. The third gear 632*d* is fixed to the outer circumferential surface of the support shaft 622 at an inner position relative to the second gear 632*b* in the vehicle width direction Dw. The third gear 632*d* is rotated together with the support shaft 622 and the second gear 632*b*.

The fourth gear 632*e* is a sprocket fixed to the brush rotary shaft 61. The fourth gear 632*e* is fixed to the outer circumferential surface of the brush rotary shaft 61 to have the same position as the third gear 632*d* in the vehicle width direction Dw. The fourth gear 632*e* is rotated together with the brush rotary shaft 61.

The second chain part 632*f* is a roller chain that connects the third gear 632*d* and the fourth gear 632*e*. As the third gear 632*d* rotates, the second chain part 632*f* rotates the fourth gear 632*e*.

As shown in FIGS. 2 to 4, the travel brush part 64 is fixed to the brush rotary shaft 61, and is rotated together with the brush rotary shaft 61. The travel brush part 64 includes a brush fixing portion 641 that is fixed to the brush rotary shaft 61, and a brush part body 642 that protrudes radially outward from the brush fixing portion 641.

The brush fixing portion 641 has the shape of a cylinder that centers on the axis O. The brush fixing portion 641 is disposed between the two first support plates 623, and is fixed to the outer circumferential surface of the brush rotary shaft 61 with the brush rotary shaft 61 inserted thereinto. The brush fixing portion 641 may be formed of a metal material or a material having an insulation property. To be specific, the brush fixing portion 641 of the present embodiment is formed of, for example, nylon or polypropylene (PP). Also, the brush fixing portion 641 may be formed of a ferrous metal or a non-ferrous metal (copper or aluminum) as the metal material, and may be formed of a fiber reinforced plastic (FRP) or vinyl chloride as the insulating material.

The brush part body 642 is a brush-like member formed to protrude from the outer circumferential surface of the brush fixing portion 641. Here, the brush-like member includes a member in which, for example, linear members each having, for example, a circular, elliptical, rectangular or polygonal external shape or cross-sectional shape and a diameter of 0.3 to 3.0 mm are bundled and fixedly buried in the brush fixing portion 641. The brush part body 642 is provided on a spiral region A formed on the outer circumferential surface of the brush fixing portion 641 in a spiral manner extending toward the vehicle width direction Dw that is an axis O direction in which the axis O extends as going toward a circumferential direction of the brush rotary shaft 61.

To be specific, the spiral region A of the present embodiment is, as shown in FIG. 3, formed to extend from the inside toward the outside of the track 2 in the vehicle width direction Dw while going from the lower side to the upper side of the track 2 in the circumferential direction of the brush rotary shaft 61. That is, the brush part body 642 protrudes from the outer circumferential surface of the brush rotary shaft 61 via the brush fixing portion 641 in a spiral shape. The brush part body 642 may be formed of a metal material or a material having an insulation property. To be specific, like the brush fixing portion 641, the brush part body 642 of the present embodiment is formed of, for example, nylon or polypropylene (PP). Also, the brush part body 642 may be a metal brush made of wires or copper wires. Also, the brush part body 642 may be a brush derived from a plant such as bamboo or palm, or a strip-shaped rubber plate.

The brush pressing part 65 keeps the travel brush part 64 away from the track surface at normal times when snow removal is not required, and brings the travel brush part 64 into contact with the track surface in the event of snowfall that requires snow removal. The brush pressing part 65 adjusts the position of the brush rotary shaft 61 such that the travel brush part 64 comes into contact with the runway 21*a* in the event of snow removal. The brush pressing part 65 of the present embodiment is pressed with a predetermined force such that the travel brush part 64 comes into contact with the runway 21*a*. To be specific, as the predetermined force, the brush pressing part 65 presses the travel brush part 64 toward the runway 21*a* with such a force that a tip of the brush part body 642 slightly comes into contact with the runway 21*a* such that a frictional force generated between the runway 21*a* and the brush part body 642 when the vehicle body 51 travels is not increased enough to impede the rotation of the brush rotary shaft 61. The brush pressing part 65 of the present embodiment includes a pressing backup part 651 that is provided for the first support plates 623, spring parts 652 that pull the pressing backup part 651 upward in the vertical direction Dv, a cylinder part 653 that presses the pressing backup part 651 toward the runway 21*a*, and a cylinder controller 654 that controls driving of the cylinder part 653.

The pressing backup part 651 is fixed to the first support plates 623. The pressing backup part 651 of the present embodiment has the shape of a column that extends in parallel to the support shafts 622 or the axis O of the brush rotary shaft 61. A position of the pressing backup part 651 in the running direction Dr is interposed between the support shaft 622 and the brush rotary shaft 61. The pressing backup part 651 is fixed to be sandwiched between support frames 651*a* that are provided to protrude upward from the first support plates 623 in the vertical direction Dv.

The spring parts 652 are connected to the pressing backup part 651 and the rear plate portion 621*c* of the mounting support part 62. The spring parts 652 bias the brush part body 642 away from the runway 21*a*. The spring parts 652 of the present embodiment are compression springs that bias the pressing backup part 651 toward the rear plate portion 621*c* to pull the pressing backup part 651. The spring parts 652 are provided side by side at two places in the vehicle width direction Dw.

The cylinder part 653 is connected to the pressing backup part 651 and the rear plate portion 621*c* of the mounting support part 62. The cylinder part 653 makes it possible to press the brush part body 642 in a direction in which the brush part body 642 is brought into contact with the runway 21*a*. The cylinder part 653 of the present embodiment is an air cylinder that is contracted or expanded by receiving a signal from the cylinder controller 654. The cylinder part 653 is in a contracted state at normal times. The cylinder part 653 is lengthened by receiving the signal from the cylinder controller 654 while adjusting an expansion/contraction amount. To be specific, the cylinder part 653 is expanded by receiving the signal from the cylinder controller 654, and thereby presses the pressing backup part 651 toward the runway 21*a* against the biasing force of the spring parts 652. Thereby, the cylinder part 653 adjusts the position of the pressing backup part 651 such that the tip of the brush part body 642 is disposed at a position at which it is in contact with the runway 21*a* while resisting the biasing force of the spring parts 652. The cylinder part 653 is provided side by side with the spring parts 652 in the vehicle width direction Dw to be sandwiched between the two spring parts 652.

The cylinder controller 654 sends a signal giving an instruction to contract or expand to the cylinder part 653. The cylinder controller 654 of the present embodiment is provided for a cab (not shown) in the vehicle body 51.

The brush back plate 67 covers an upper side of the travel brush part 64 in the vertical direction Dv and a rear side of the travel brush part 64 in the running direction Dr. The brush back plate 67 of the present embodiment is fixed to the two first support plates 623 that are separated in the vehicle width direction Dw. The brush back plate 67 is mounted at a position at which it is not in contact with the brush part body 642. The brush back plate 67 is formed to gradually increase in diameter from the inside toward the outside of the track 2 in the vehicle width direction Dw such that the distance from the brush back plate 67 to the tip of the brush part body 642 increases.

Next, an operation of the snow removal device 60 of the first embodiment will be described.

In the first embodiment, in the event of snowfall, a signal is sent from the cylinder controller 654 to the cylinder part 653 by a driver who drives the vehicle body 51. As the cylinder part 653 receives the signal, the cylinder part 653 is expanded against the biasing force of the spring parts 652, and pushes the pressing backup part 651 downward in the vertical direction Dv up to a position at which the tip of the brush part body 642 comes into contact with the runway 21*a*.

As the pressing backup part 651 is pushed downward, the first support plates 623 are pushed and rotated about the support shafts 622 via the support frames 651*a* on which the pressing backup part 651 is mounted. As the first support plates 623 are rotated about the support shafts 622, the brush rotary shaft 61 is lowered downward in the vertical direction Dv, and the tip of the brush part body 642 comes into contact with the runway 21*a*. Also, as the first support plates 623 are rotated, the second support plates 624 fixed to the first support plates 623 are also rotated. Thereby, the contact portion 631*b* is disposed at a position at which the contact portion 631*b* comes into contact with the running wheel 511.

In the state in which the contact portion 631*b* is in contact with the running wheel 511, the vehicle body 51 travels by rotating the running wheel 511, and thereby the contact portion 631*b* is rotated in the direction opposite to the rotation direction of the running wheel 511 together with the contact shaft body 631*a*. When the contact shaft body 631*a* is rotated, the first gear 632*a* is rotated, and rotates the second gear 632*b* via the first chain part 632*c* in the direction opposite to the rotation direction of the running wheel 511.

As the second gear 632*b* is rotated, the support shaft 622 to which the second gear 632*b* is fixed is rotated together with the third gear 632*d*. As the third gear 632*d* is rotated, the fourth gear 632*e* is rotated via the second chain part 632*f*, and rotates the brush rotary shaft 61 in the direction opposite to the rotation direction of the running wheel 511. As the brush rotary shaft 61 is rotated, the brush fixing portion 641 is rotated from the lower side in the vertical direction Dv toward the front in the running direction Dr in the direction opposite to the rotation direction of the running wheel 511 while bringing the tip of the brush part body 642 into contact with the runway 21*a*.

According to the snow removal device 60 as described above, the cylinder part 653 presses the pressing backup part 651 toward the runway 21*a* such that the tip of the brush part body 642 slightly comes into contact with the runway 21*a*, and the brush part body 642 comes into contact with the runway 21*a*. In this state, the rotation of the running wheel 511 is transmitted by the speed change part 632, and the brush rotary shaft 61 is rotated in the direction opposite to the rotation direction of the running wheel 511. For this reason, snow that has accumulated on the runway 21*a* can be scraped out from the lower side toward the upper side in the vertical direction Dv by the brush part body 642. For example, when the brush rotary shaft 61 is rotated in the same direction as the running wheels 511, the brush part body 642 may press down the forward snow in the running direction Dr from the upper side to the lower side in the vertical direction Dv, and be formed in the shape of pressed snow. In contrast, the brush rotary shaft 61 is rotated in the direction opposite to the rotation direction of the running wheel 511 and scrapes out snow to scoop up snow from the lower side to the upper side in the vertical direction Dv. Thereby, snow that has accumulated on the runway 21*a* can be efficiently removed without compression.

Further, the brush part body 642 is provided on the spiral region A formed to extend from the inside toward the outside of the track 2 in the vehicle width direction Dw while going from the lower side in the vertical direction Dv toward the front in the running direction Dr and then toward the upper side in the vertical direction Dv in the circumferential direction. Thereby, snow scraped out from the top of the runway 21*a* can be sent outward in the vehicle width direction Dw but not forward in the running direction Dr. Therefore, snow that has accumulated on the runway 21*a* in front of the running wheel 511 can be efficiently removed outward in the vehicle width direction Dw.

Also, in the state in which the brush part body 642 is in contact with the runway 21*a*, the brush rotary shaft 61 is rotated. Thereby, the brush part body 642 comes into contact with the runway 21*a* over the entire circumferential area thereof. Therefore, it is possible to make the amount of wear of the brush part body 642 uniform in the circumferential direction of the brush part body 642, and to inhibit the amount of wear of the brush part body 642 from being partly increased. Accordingly, it is possible to reduce the influence of damage caused by the wear of the brush part body 642.

Thus, while the damage caused by the wear of the brush part body 642 is limited, snow that has accumulated on the runway 21*a* can be efficiently removed.

In addition, as the cylinder part 653 adjusts the position of the pressing backup part 651 against the biasing force of the spring parts 652, the brush pressing part 65 can dispose the travel brush part 64 at the position at which the frictional force generated between the runway 21*a* and the brush part body 642 during travel is not increased enough to impede the rotation of the brush rotary shaft 61. For this reason, the brush rotary shaft 61 can be rotated against the frictional force generated by the contact of the tip of the brush part body 642 with the runway 21*a*.

Therefore, the brush part body 642 can be rotated in the direction opposite to the rotation direction of the running wheel 511 with the tip thereof brought into contact with the runway 21*a* with high precision. As a result, it is possible to scrape out snow that has accumulated on the runway 21*a* from the lower side to the upper side of the track 2 in the vertical direction Dv with high precision. Thereby, snow that has accumulated on the runway 21*a* can be efficiently removed.

Also, the rotation of the running wheel 511 increases the rotating speed of the brush rotary shaft 61 due to the speed change part 632, and is transmitted to the brush rotary shaft 61. Thereby, it is possible to rotate the brush rotary shaft 61 such that the relative rotating speed on the contact surface coming into contact with the runway 21*a* is faster than the relative rotating speed on the contact surface of the running wheels 511 which comes into contact with the runway 21*a* during travel. For this reason, it is possible to bring the tip of the brush part body 642 into contact with snow that has accumulated on the runway 21*a* at a high speed. As a result, it is possible to scrape out snow that has accumulated on the runway 21*a* to scoop up snow from the lower side to the upper side of the track 2 in the vertical direction Dv with a great force. Thereby, snow that has accumulated on the runway 21*a* can be more efficiently removed.

Also, the brush part body 642 is in a state withdrawn from the runway 21*a* by the spring parts 652 at a normal time, and when snow removal work is done, the pressing backup part 651 is pressed with a predetermined force such that the tip of the brush part body 642 is slightly brought into contact by the cylinder part 653, and adjusts the position of the brush part body 642. Thereby, only if necessary, it is possible to bring the brush part body 642 into contact with the runway 21*a*. Also, the tip of the brush part body 642 can be brought into contact with the runway 21*a* with an optimal force by the cylinder part 653. Thereby, it is possible to further reduce the amount of wear of the brush part body 642. In addition, even if the cylinder part 653 fails, the spring parts 652 spontaneously raise the pressing backup part 651. Thereby, the brush part body 642 can be separated from the runway 21*a*, and a fail-safe structure can be constituted by the spring parts 652.

Also, as the rotation of the running wheel 511 is transmitted to the brush rotary shaft 61 via the speed change part 632, the snow removal device 60 can be constituted without the power source for rotating the brush rotary shaft 61 being prepared outside.

Also, the brush back plate 67 covers the upper side of the travel brush part 64 in the vertical direction Dv and the rear side of the travel brush part 64 in the running direction Dr. Thereby, it is possible to inhibit and protect the scraped snow from being scattered toward the running wheel 511 and the vehicle body 51. Further, the brush back plate 67 is formed by gradually increasing in diameter from the inside toward the outside of the track 2 in the vehicle width direction Dw. Thereby, the brush part body 642 formed on the outer circumferential surface of the brush fixing portion 641 in a spiral shape can adequately protect regions such as the running wheel 511, the vehicle body 51, and so on, on which scattering of snow removed from the top of the runway 21*a* is undesirable without obstructing snow from being sent outward in the vehicle width direction Dw.

In addition, the vehicle 5 that is equipped with the snow removal device 60 as described above and is at the forefront in the running direction Dr is connected. Thereby, the vehicle 5 can be efficiently driven while removing snow that has accumulated on the runway 21*a*. For this reason, it is possible to limit service disruptions or train delays caused by the accumulated snow.

Figure 5:
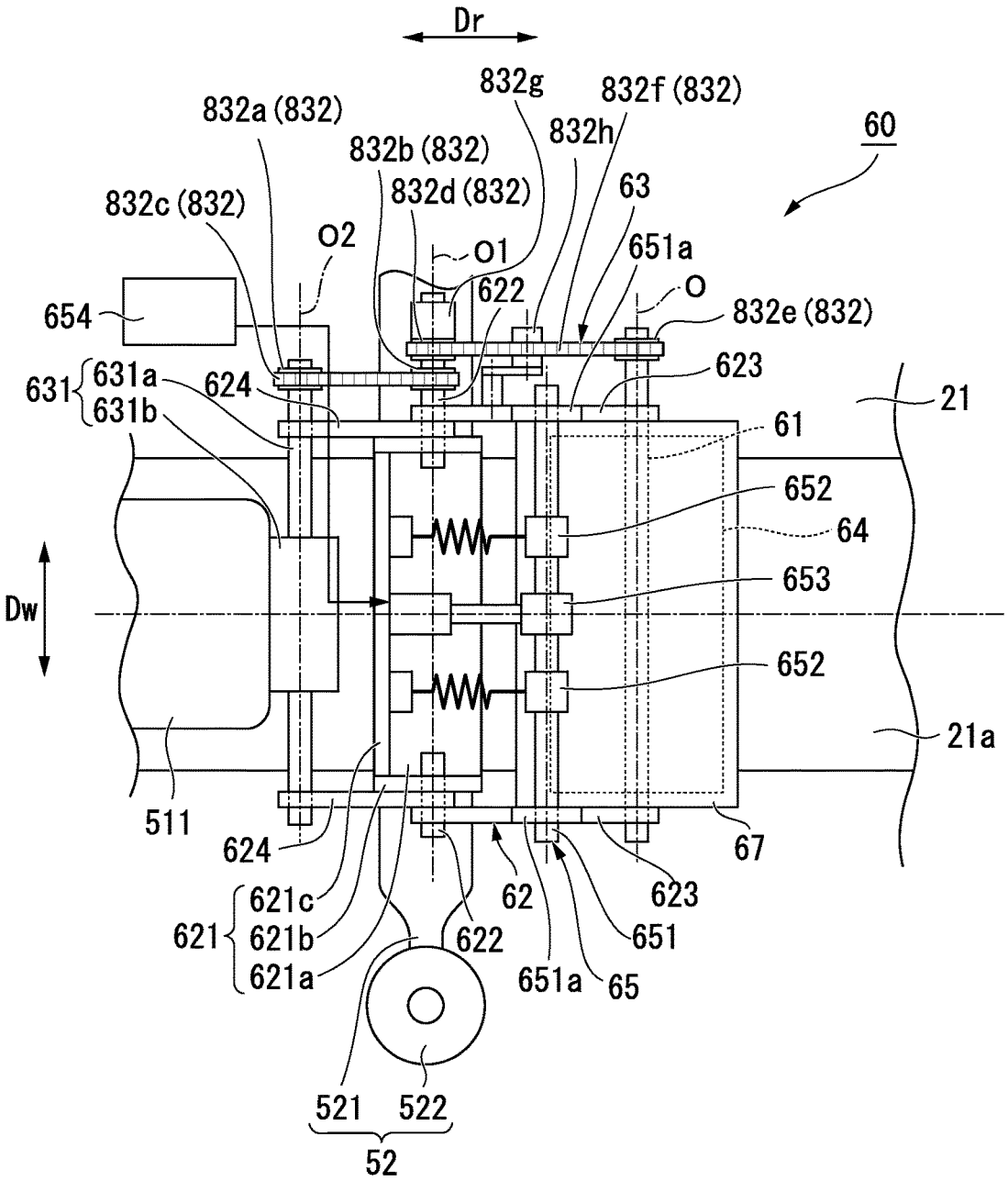
FIG. 5 is a view of a snow removal device in a first modification of the first embodiment of the present invention when viewed from above in the vertical direction.
Figure 6:
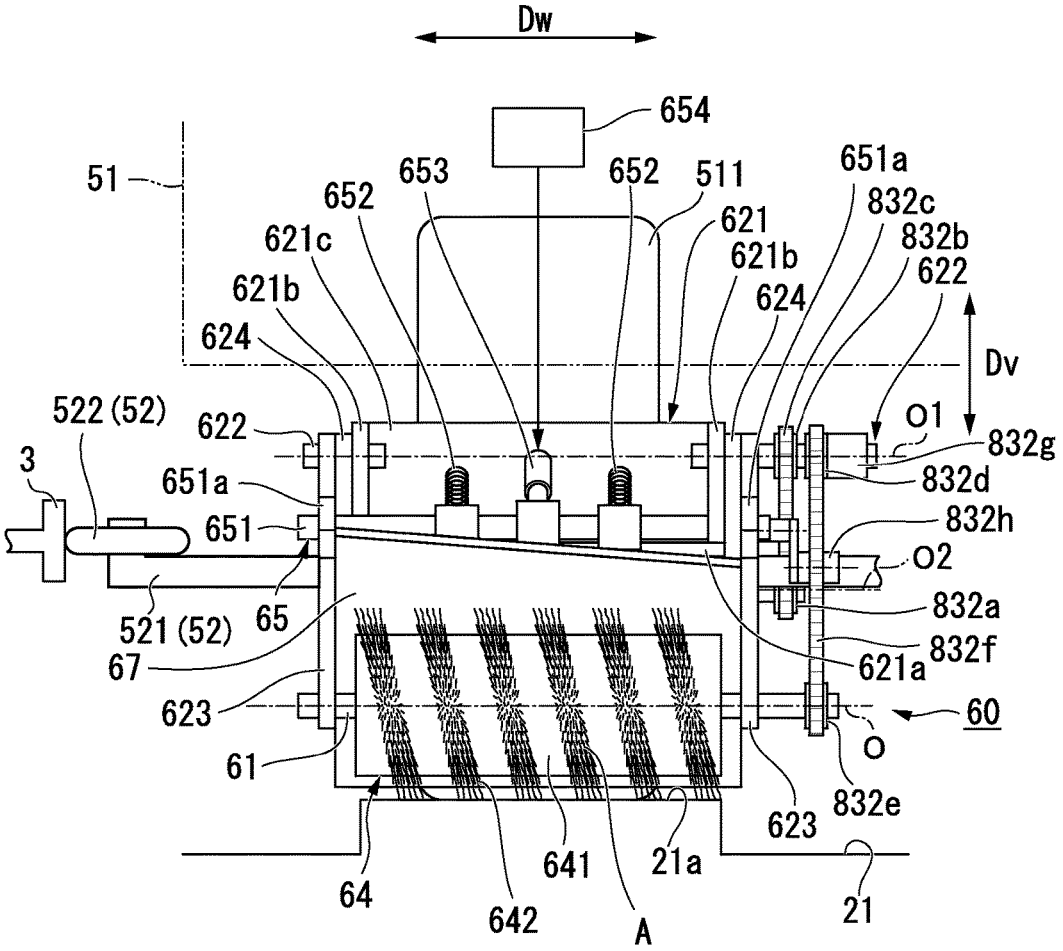
FIG. 6 is a view of the snow removal device in the first modification of the first embodiment of the present invention when viewed from the front in the running direction.

The speed change part 632 of the first embodiment is not limited to the structure of the present embodiment, and any structure capable of increasing the rotating speed of the running wheel 511 to transmit it to the brush rotary shaft 61 may be used. For example, the speed change part 632 may be configured to change the number of rotations of the brush rotary shaft 61 such that the number of optimal rotations of the travel brush part 64 can be selected depending on the speed of the vehicle body 51. For example, as a first modification of the first embodiment, as shown in FIGS. 5 and 6, the speed change part 632 may be used as a speed change part 832 configured to combine V pulleys and V belts, instead of the sprockets such as the first to fourth gears 632*a* to 632*e* and the first and second chain parts 632*c* and 632*f*.

To be specific, the speed change part 832 of the first modification includes a first V pulley 832*a* that is provided for a contact shaft body 631*a* instead of the first gear 632*a*, a second V pulley 832*b* that is provided for a support shaft 622 instead of the second gear 632*b*, and a first V belt 832*c* that connects the first V pulley 832*a* and the second V pulley 832*b* like the first chain part 632*c*. The speed change part 832 includes a third V pulley 832*d* that is provided for the support shaft 622 side by side with the second V pulley 832*b* like the third gear 632*d*, a fourth V pulley 832*e* that is provided for a brush rotary shaft 61 like the fourth gear 632*e*, and a second V belt 832*f* that connects the third V pulley 832*d* and the fourth V pulley 832*e* like the second chain part 632*f*. The speed change part 832 includes a V pulley width change device 832*g* that moves the third V pulley 832*d* that is the speed change pulley, and a V belt tensioner 832*h* that constantly maintains tension of the second V belt 832*f* in spite of a change in speed when the speed is changed by changing a width of the third V pulley 832*d* using the V pulley width change device 832*g* and changing a relevant diameter of the second V belt 832*f*.

The V belt tensioner 832*h* functions to constantly hold tension applied to the second V belt 832*f*. The V belt tensioner 832*h* of the present embodiment includes a cantilever arm that is fixed to the first support plates 623, and a support pulley that pushes a rear surface that is an inner surface of the second V belt 832*f*.

In this constitution, the speed change part 832 changes the width of the third V pulley 832*d* using the V pulley width change device 832*g* while adjusting an amount by which the V belt tensioner 832*h* pushes the second V belt 832*f*. For this reason, the speed change part 832 changes the width of the third V pulley 832*d* used instead of the third gear 632*d*, and thereby can adjust a diameter of the second V belt 832*f* applied to the third V pulley 832*d* to change the number of rotations of the brush rotary shaft 61. Thereby, it is possible to rotate the travel brush part 64 with the number of rotations most suitable for snow removal in harmony with the speed of the vehicle body 51 which is appropriate for a type or an amount of snow that has accumulated on the runway 21*a*.

Figure 7:
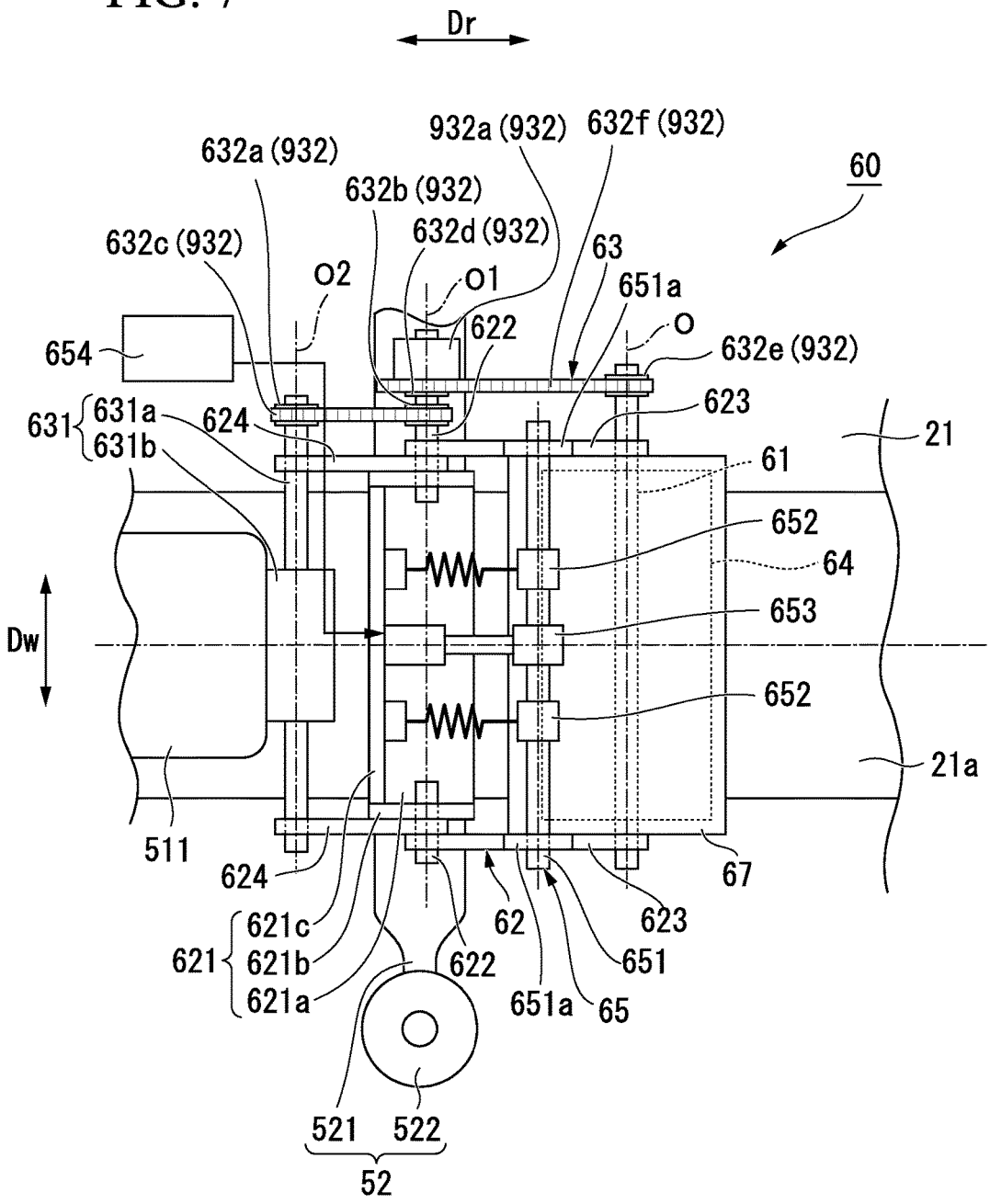
FIG. 7 is a view of a snow removal device in a second modification of the first embodiment of the present invention when viewed from above in the vertical direction.
Figure 8:
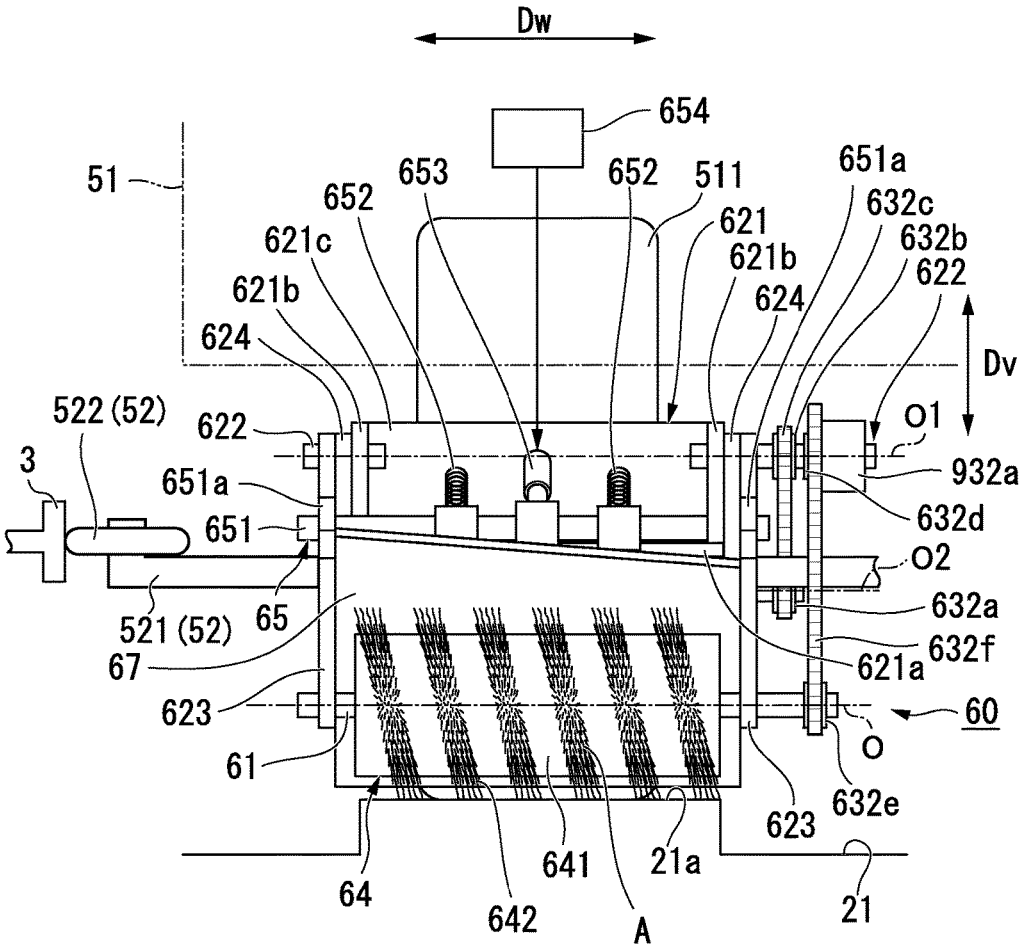
FIG. 8 is a view of the snow removal device in the second modification of the first embodiment of the present invention when viewed from the front in the running direction.

Also, as a second modification of the speed change part 632 of the first embodiment, as in FIGS. 7 and 8, a speed change part 932 having an internal speed changer 932*a* like a shift stage of a bicycle may be used. To be specific, the internal speed changer 932*a* is disposed outside the third gear 632*d* in the vehicle width direction Dw. Since shift gears of a planetary gear mechanism are incorporated in the internal speed changer 932*a*, tension applied to a chain is not changed. Thus, no chain tensioner is required, and there is no need to move the chain. The internal speed changer 932*a* is changed in speed by the shift mechanism incorporated therein.

With the use of this constitution, it is possible to rotate the travel brush part 64 with the number of rotations most suitable for snow removal in harmony with the speed of the vehicle body 51 which is appropriate to the type or the amount of snow that has accumulated on the runway 21*a*.

(Second Embodiment)

Next, a snow removal device 70 of a second embodiment will be described with reference to FIGS. 9 to 11.

In the second embodiment, the same components as in the first embodiment are given the same symbols, and a detailed description thereof will be omitted. The snow removal device 70 of the second embodiment is different from that of the first embodiment in that a brush rotary shaft 61 is independently rotated and a brush part body 642 has a different shape.

The snow removal device 70 of the second embodiment is equipped with a rotation drive part 71 that rotates the brush rotary shaft 61 about an axis O instead of the rotation transmission part 63, and a controller 72 that controls the rotation drive part 71. Also, the snow removal device 70 of the second embodiment is equipped with a symmetrical travel brush part 73 in which a region in which the brush part body 642 is formed is different from that of the travel brush part 64 of the first embodiment.

The rotation drive part 71 independently rotates the brush rotary shaft 61 regardless of a traveling condition of a vehicle body 51. As shown in FIG. 9, the rotation drive part 71 of the present embodiment is a motor that is connected to a brush rotor inside the first support plates 623 in a vehicle width direction Dw. The rotation drive part 71 rotates the brush rotary shaft 61 at an arbitrary rotating speed based on a signal from the controller 72.

The controller 72 sends a signal to the rotation drive part 71, and thereby has control of adjustment of a rotating speed of the brush rotary shaft 61. The controller 72 of the present embodiment has control of adjustment of a pressing force of the brush pressing part 65 in place of the cylinder controller 654 of the first embodiment. The controller 72 of the present embodiment sends the signal to the rotation drive part 71 such that the brush rotary shaft 61 has an arbitrary rotating speed. The controller 72 sends a signal giving an instruction to contract or expand to a cylinder part 653. The controller 72 of the present embodiment is provided for a cab (not shown) of the vehicle body 51, and is operated along with traveling of the vehicle body 51 by a driver who drives the vehicle body 51. To be specific, the controller 72 adjusts the brush rotary shaft 61 to be rotated at a faster speed than a relative rotating speed of a running wheel 511 relative to a runway 21*a*, like the speed change part 632 of the first embodiment.

Figure 9:
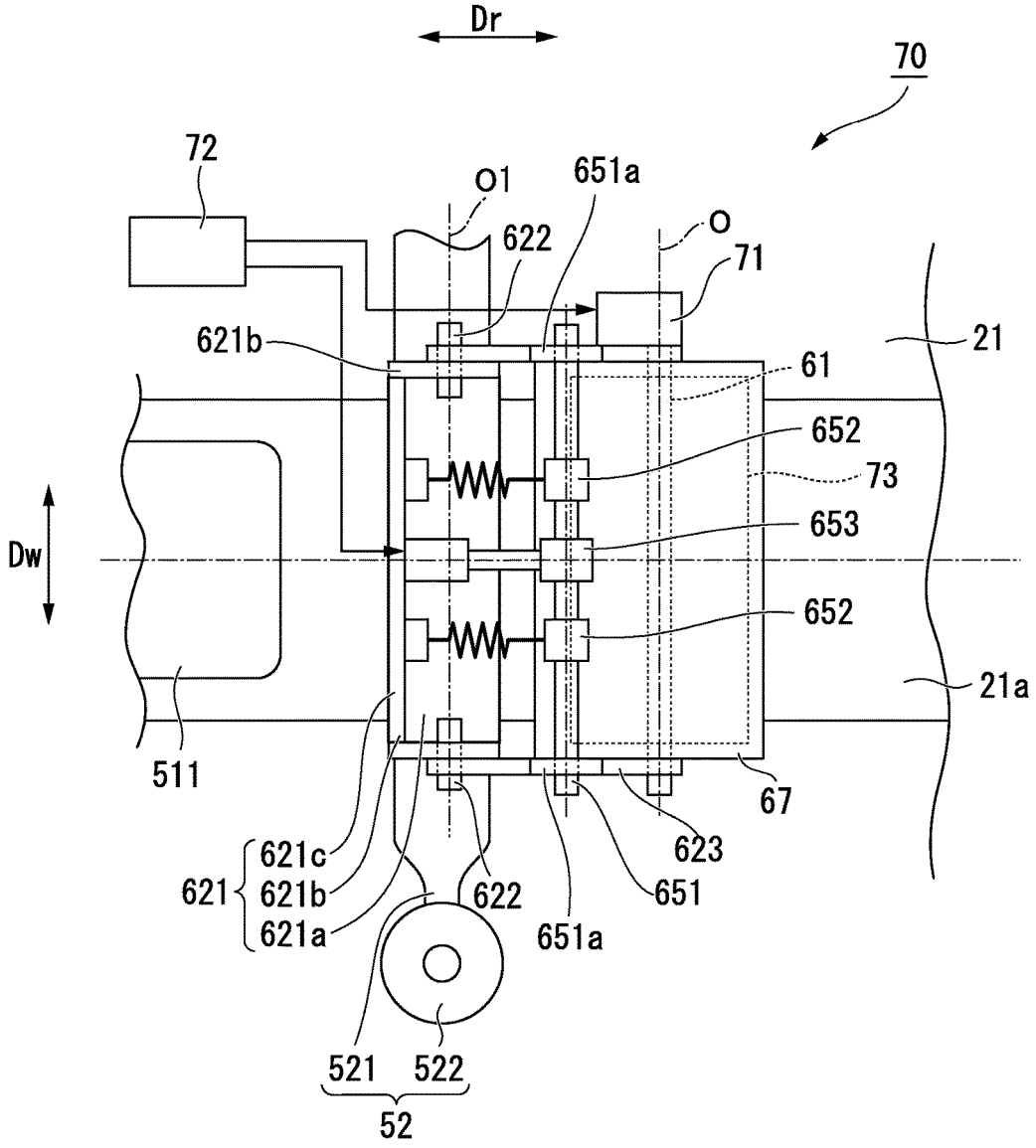
FIG. 9 is a view of a snow removal device in a second embodiment of the present invention when viewed from above in the vertical direction.
Figure 10:
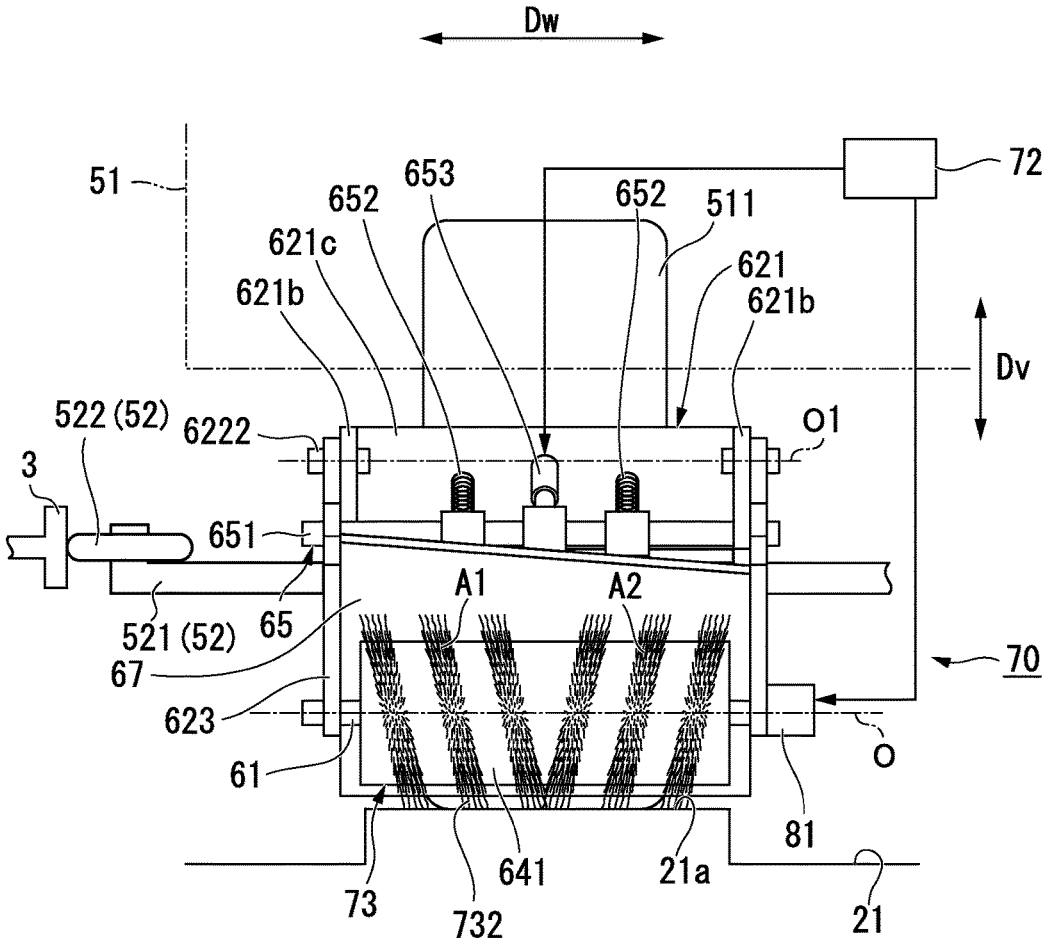
FIG. 10 is a view of the snow removal device in the second embodiment of the present invention when viewed from the front in the running direction.
Figure 11:
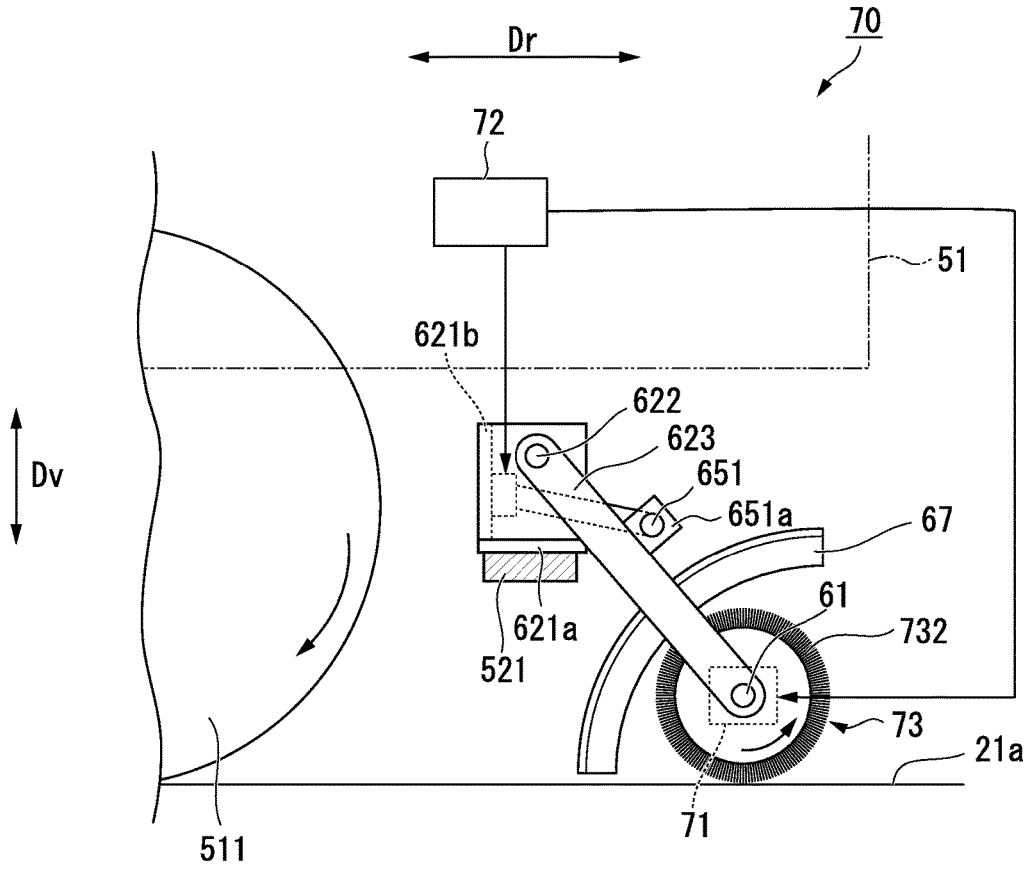
FIG. 11 is a view of the snow removal device in the second embodiment of the present invention when viewed from outside in the vehicle width direction.

As shown in FIGS. 9 to 11, the symmetrical travel brush part 73 is fixed to the brush rotary shaft 61, and is rotated together with the brush rotary shaft 61. The symmetrical travel brush part 73 includes a brush fixing portion 641 similar to that of the first embodiment, and symmetrical brush part bodies 732 that protrude radially outward from the brush fixing portion 641.

Unlike the brush part body 642 of the first embodiment, the symmetrical brush part bodies 732 are different in a direction of a spiral region A in the middle of an axis O direction. To be specific, the spiral region A in which the symmetrical brush part bodies 732 are provided has a first spiral region A1 that is formed in the same direction as the spiral region A, and a second spiral region A2 that is formed on an outer circumferential surface of the brush rotary shaft 61 in a direction opposite to the first spiral region A1, using a center position in the axis O direction as a boundary.

The first spiral region A1 is formed on an outer circumferential surface of the brush fixing portion 641 to extend to one side in the axis O direction from the center position in the axis O direction toward first direction in the circumferential direction. The first spiral region A1 of the present embodiment is formed outward in the vehicle width direction Dw using the center position in the axis O direction as the boundary. To be specific, as shown in FIG. 11, the first spiral region A1 of the present embodiment is formed to extend from the inside toward the outside of the track 2 in the vehicle width direction Dw while going from a lower side toward an upper side in the circumferential direction of the brush rotary shaft 61.

The second spiral region A2 is formed on the outer circumferential surface of the brush fixing portion 641 toextend to one side in the axis O direction from the center position in the axis O direction toward second direction in the circumferential direction. The second spiral region A2 of the present embodiment is formed inward in the vehicle width direction Dw using the center position in the axis O direction as the boundary. To be specific, as shown in FIG. 11, the second spiral region A2 of the present embodiment is formed to extend from the outside toward the inside of the track 2 in the vehicle width direction Dw while going from a lower side toward an upper side in the circumferential direction of the brush rotary shaft 61.

That is, the symmetrical brush part bodies 732 protrude from the circumferential surface of the brush rotary shaft 61 via the brush fixing portion 641 using the center position in the axis O direction as the boundary in spiral shapes wound in opposite directions.

Like the brush part body 642 of the first embodiment, the symmetrical brush part bodies 732 are formed of a material having an insulation property.

Next, an operation of the snow removal device 70 of the second embodiment will be described.

In the second embodiment, in the event of snowfall, a signal is sent from the controller 72 to the cylinder part 653 by a driver who drives the vehicle body 51. As the cylinder part 653 receives the signal, the cylinder part 653 is expanded against a biasing force of spring parts 652, and pushes a pressing backup part 651 downward in the vertical direction Dv up to a position at which the tips of the symmetrical brush part bodies 732 come into contact with the runway 21*a*. As the pressing backup part 651 is pushed downward, the first support plates 623 are pushed and rotated about support shafts 622 via support frames 651*a* on which the pressing backup part 651 is mounted. As the first support plates 623 are rotated about the support shafts 622, the brush rotary shaft 61 is lowered downward in the vertical direction Dv, and the tips of the symmetrical brush part bodies 732 come into contact with the runway 21*a*.

A signal is sent from the controller 72 to the cylinder part 653, and another signal is sent to the rotation drive part 71. The rotation drive part 71 rotates the brush rotary shaft 61 at a rotating speed based on the signal from the controller 72. To be specific, the controller 72 sends the signal to the rotation drive part 71 that rotates the brush rotary shaft 61 at a faster speed than the relative rotating speed of the running wheel 511 relative to the runway 21*a*. The rotation drive part 71 receiving the signal rotates the brush rotary shaft 61 at a rotating speed based on the signal. As the brush rotary shaft 61 is rotated by the rotation drive part 71, the brush fixing portion 641 is rotated in the direction opposite to the rotation direction of the running wheel 511 from the lower side in the vertical direction Dv toward the front in the running direction Dr while bringing the tips of the symmetrical brush part bodies 732 into contact with the runway 21*a*.

According to the snow removal device 70 as described above, the spiral region A has the first spiral region A1 and the second spiral region A2 using the center position in the axis O direction as the boundary. Thereby, snow scraped out from the top of the runway 21*a* can be sent inward and outward in the vehicle width direction Dw rather than forward in the running direction Dr by the symmetrical brush part bodies 732.

To be specific, the symmetrical brush part body 732 provided in the first spiral region A1 is formed to extend from the inside toward the outside of the track 2 in the vehicle width direction Dw while going from the lower side toward the front and then toward the upper side in the circumferential direction of the brush rotary shaft 61. For this reason, the symmetrical brush part body 732 provided in the first spiral region A1 can scrape out and send snow, which has accumulated outward from the vicinity of the center of the runway 21*a* in the vehicle width direction Dw, toward the outside of the track 2 in the vehicle width direction Dw rather than the front in the running direction Dr.

Also, the symmetrical brush part body 732 provided in the second spiral region A2 is formed toextend from the outside toward the inside of the track 2 in the vehicle width direction Dw while going from the lower side toward the front and then toward the upper side in the circumferential direction of the brush rotary shaft 61. For this reason, the symmetrical brush part body 732 provided in the second spiral region A2 can scrape out and send snow that has accumulated inward from the vicinity of the center of the runway 21*a* in the vehicle width direction Dw toward the inside of the track 2 in the vehicle width direction Dw rather than the front in the running direction Dr.

Therefore, snow that has accumulated on the runway 21*a* can be sent toward a near side in the vehicle width direction Dw using the vicinity of the center of the runway 21*a* in the vehicle width direction Dw as the boundary. Thereby, even if snow is simply sent only to one side such as the outside of the track 2 in the vehicle width direction Dw, snow on the runway 21*a* can be efficiently removed.

Also, the controller 72 controls adjustment of the pressing force of the cylinder part 653 of the brush pressing part 65 as well as the rotating speed of the brush rotary shaft 61 via the rotation drive part 71. Thereby, it is possible to adjust the pressing force of the symmetrical brush part bodies 732 against the runway 21*a* and the rotating speed of the symmetrical brush part bodies 732 depending on the type or amount of snow. For this reason, it is possible to adequately bring the tips of the symmetrical brush part bodies 732 into contact with the runway 21*a* according to a snowfall situation or a situation of the accumulated snow. Thereby, snow on the runway 21*a* can be still more efficiently removed.

The snow removal device 70 of the second embodiment is not limited to the structure in which a combination of the rotation drive part 71 and the controller 72 is provided, and a structure having only the rotation drive part 71 may be used.

Also, as in the present embodiment, the rotation drive part 71 is not limited to the structure in which it is provided inside the brush rotary shaft 61 in the vehicle width direction Dw, and may be mounted outside the brush rotary shaft 61 or in the brush rotary shaft 61 itself.

Also, as in the present embodiment, the controller 72 is not limited to performing control of adjustment of the rotating speed, and may perform control of adjustment of a rotational direction.

In addition, as in the present embodiment, the spiral region A is not limited to the structure in which it is divided into the first spiral region A1 and the second spiral region A2 using the center position in the axis O direction as the boundary. The spiral region A may be divided into the first spiral region A1 and the second spiral region A2 from an intermediate position in the axis O direction. For example, the spiral region A may be divided into the first spiral region A1 and the second spiral region A2 at a position which is near the inside or outside of the track 2 in the vehicle width direction Dw relative to the center position in the axis O direction. Also, the first spiral region A1 and the second spiral region A2 are not limited to the case in which they are continuously formed as in the present embodiment. For example, an interval may be formed between the first spiral region A1 and the second spiral region A2, and the first spiral region A1 and the second spiral region A2 may be formed away from each other in the axis O direction.

(Third Embodiment)

Next, a snow removal device 80 of a third embodiment will be described with reference to FIG. 12.

In the third embodiment, the same components as in the first or second embodiment are given the same symbols, and a detailed description thereof will be omitted. The snow removal device 80 of the third embodiment is different from those of the first and second embodiments with regard to a direction in which a brush rotary shaft 61 extends.

The snow removal device 80 of the third embodiment has, in place of the brush rotary shaft 61, an oblique brush rotary shaft 81 in which an axis O is obliquely disposed such that first end thereof in a vehicle width direction Dw is located forward in a running direction Dr relative to second end thereof. In the snow removal device 80 of the third embodiment, the same travel brush part 64 as in the first embodiment is fixed to an outer circumferential surface of the oblique brush rotary shaft 81.

Figure 12:
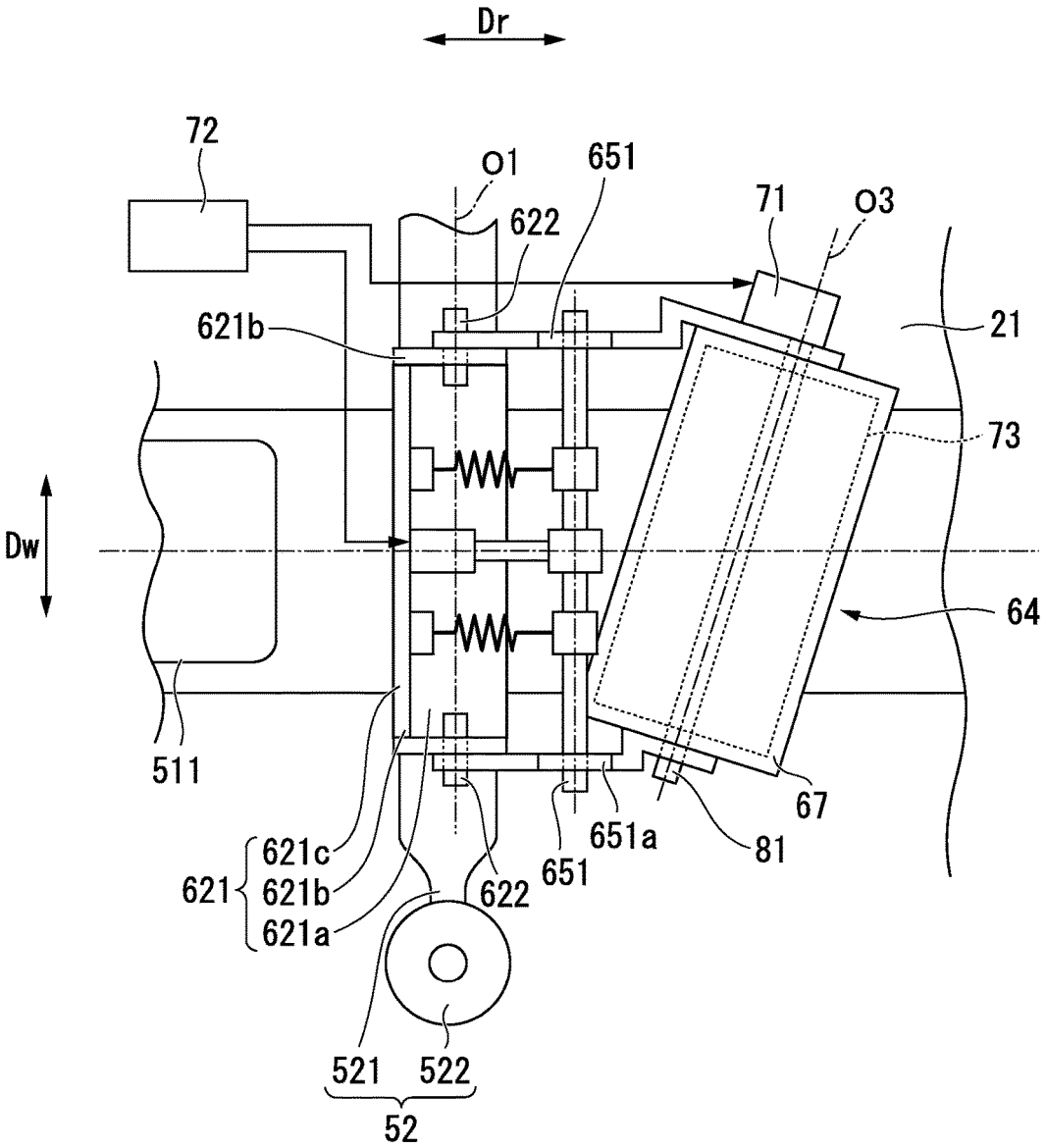
FIG. 12 is a view of a snow removal device in a third embodiment of the present invention when viewed from above in the vertical direction.

As shown in FIG. 12, the snow removal device 80 of the third embodiment is rotated about an oblique axis O3 that obliquely extends relative to the vehicle width direction Dw such that the inside of track 2 in the vehicle width direction Dw is located forward in the running direction Dr relative to the outside of track 2 in the vehicle width direction Dw. In the third embodiment, the oblique axis O3 extends on the same horizontal plane as the axis O, and obliquely extends with respect to the axis O to go forward in the running direction Dr as going from the outside toward the inside of the track 2 in the vehicle width direction Dw. The oblique brush rotary shaft 81 has the shape of a column that extends centering on the oblique axis O3. Therefore, the oblique brush rotary shaft 81 is configured such that an inner end thereof in the vehicle width direction Dw is disposed forward in the running direction Dr relative to an outer end thereof in the vehicle width direction Dw. That is, the oblique brush rotary shaft 81 is obliquely disposed directed outward in the vehicle width direction Dw.

According to the snow removal device 80 of the third embodiment as described above, the oblique brush rotary shaft 81 in which the inner end thereof in the vehicle width direction Dw is disposed forward in the running direction Dr relative to the outer end thereof in the vehicle width direction Dw is used. Thereby, snow scraped out of the runway 21*a* by a brush part body 642 can be moved outward in the vehicle width direction Dw. Therefore, the oblique brush rotary shaft 81 is inclined directed toward the outside of the track 2 in the vehicle width direction Dw. Thereby, the brush part body 642 provided in a spiral region A is rotated, and thereby snow scraped out from the top of the runway 21*a* can be more efficiently sent outward in the vehicle width direction Dw.

Although embodiments of the present invention have been described above in detail with reference to the drawings, the constitutions and combinations in these embodiments are mere examples, and additions, omissions, substitutions, and other modifications of the constitution are possible without departing from the spirit of the present invention. Also, the present invention is not limited by the above description, and is only limited by the claims.

The snow removal device is not limited to being provided for the vehicle 5 disposed at the forefront of the combination vehicle as in the present embodiment, but may be provided for a rearmost vehicle 5. When the snow removal device is provided for the foremost and rearmost vehicles 5, even if the front and the rear of the vehicle 5 in the running direction Dr are switched, for example, in a shuttle service, snow on the runway 21*a* can be removed.

In addition, the brush part body 642 and the symmetrical brush part bodies 732 of the present embodiment need to be formed of the insulating material, and are not limited to the brush shape. For example, the brush part body 642 and the symmetrical brush part bodies 732 may protrude from the spiral region A of the brush fixing portion 641 in a flat plate shape.

What is claimed is:

1. A snow removal device comprising:

a brush rotary shaft that is mounted on a vehicle body traveling along a track in front of running wheel provided for the vehicle body in a running direction in which the vehicle body travels and that is rotated about an axis extending in a direction along a vehicle width direction of the vehicle body in a direction opposite to the rotation direction of the running wheel;

a travel brush part that protrudes radially outward from an outer circumferential surface of the brush rotary shaft and comes into contact with a runway of the track with which the running wheel is in contact; and a brush pressing part that presses the travel brush part toward the runway, wherein the travel brush part is provided in a spiral region formed on the outer circumferential surface of the brush rotary shaft in a spiral manner extending toward an axis direction in which the axis extends as going toward a circumferential direction of the brush rotary shaft, and wherein the spiral region includes a first spiral region that is formed on the outer circumferential surface of the brush rotary shaft to extend toward the axis direction as going toward a first direction in the circumferential direction.

2. The snow removal device according to claim 1, wherein the brush rotary shaft is rotated against a frictional force generated by contact of the travel brush part with the runway when the vehicle body travels.

3. The snow removal device according to claim 1, wherein the brush rotary shaft is rotated such that a relative rotating speed of the brush rotary shaft relative to the runway is faster than that of the running wheel relative to the runway.

4. The snow removal device according to claim 1, wherein the first spiral region is formed on the outer circumferential surface of the brush rotary shaft from an intermediate position of the outer circumferential surface of the brush rotary shaft in the axis direction, and wherein the spiral region further includes a second spiral region that is formed on the outer circumferential surface of the brush rotary shaft to extend toward the axis direction from the intermediate position of the outer circumferential surface of the brush rotary shaft in the axis direction as going toward a second direction in the circumferential direction.

5. The snow removal device according to claim 1, further comprising a controller configured to control so as to adjust rotation of the brush rotary shaft and a pressing force of the brush pressing part.

6. The snow removal device according to claim 1, wherein the axis is obliquely disposed such that a first end of the brush rotary shaft in the vehicle width direction is located forward in the running direction relative to a second end of the brush rotary shaft in the vehicle width direction.

7. A vehicle equipped with the vehicle body including the snow removal device according to claim 1.

8. A track transportation system comprising:

the vehicle according to claim 7; and a track along which the vehicle body travels.

9. A snow removal device comprising:

a brush rotary shaft that is mounted on a vehicle body traveling along a track in front of running wheel provided for the vehicle body in a running direction in which the vehicle body travels and that is rotated about an axis extending in a direction along a vehicle width direction of the vehicle body in a direction opposite to the rotation direction of the running wheel;

a travel brush part that protrudes radially outward from an outer circumferential surface of the brush rotary shaft and comes into contact with a runway of the track with which the running wheel is in contact and a brush pressing part that presses the travel brush part toward the runway, a rotation transmission part configured to transmit rotation of the running wheel to rotate the brush rotary shaft, wherein the travel brush part is provided in a spiral region formed on the outer circumferential surface of the brush rotary shaft in a spiral manner extending toward an axis direction in which the axis extends as going toward a circumferential direction of the brush rotary shaft, and wherein the rotation transmission part includes:

a running wheel contact shaft that rotates while coming into contact with the running wheel; and a speed change part that changes a rotating speed of the running wheel contact shaft and transmits the changed rotating speed to the brush rotary shaft.

10. The snow removal device according to claim 9, wherein the speed change part changes the number of rotations of the brush rotary shaft depending on a speed of the vehicle body.

* * * * *